US009414723B2

(12) United States Patent
Capraro et al.

(10) Patent No.: US 9,414,723 B2
(45) Date of Patent: Aug. 16, 2016

(54) PORTABLE TOILET DEVICE FOR A SMALL CHILD

(71) Applicant: Helen of Troy Limited, Belleville, St. Michael (BB)

(72) Inventors: Peter I. Capraro, San Francisco, CA (US); Tucker H. Fort, Brooklyn, NY (US); Thomas C. Hanson, New York, NY (US); Troy H. Phipps, Brooklyn, NY (US); Erica Eden Cohen, New York, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 141 days.

(21) Appl. No.: 14/222,003

(22) Filed: Mar. 21, 2014

(65) Prior Publication Data

US 2015/0265109 A1 Sep. 24, 2015

(51) Int. Cl.
*A47K 13/06* (2006.01)
*A47K 11/04* (2006.01)

(52) U.S. Cl.
CPC ..... *A47K 13/06* (2013.01); *A47K 11/04* (2013.01)

(58) Field of Classification Search
CPC ..... A47K 11/00; A47K 11/02; A47K 11/04; A47K 11/06
See application file for complete search history.

(56) References Cited

U.S. PATENT DOCUMENTS

| | | | | |
|---|---|---|---|---|
| 2,804,121 | A | 8/1957 | Singleton | |
| 5,005,223 | A | 4/1991 | Greenwood | |
| 5,155,871 | A | 10/1992 | Sams | |
| 5,309,580 | A | 5/1994 | Amalsad | |
| 5,685,029 | A * | 11/1997 | Gee | A47K 11/06 4/239 |
| 5,974,598 | A | 11/1999 | Granda-Cabrera | |
| 6,341,386 | B1 | 1/2002 | Phillips | |
| 7,404,499 | B1 * | 7/2008 | Ramsey | B65F 1/062 220/495.06 |
| 7,770,242 | B2 | 8/2010 | Sell | |
| 8,166,581 | B2 | 5/2012 | Lovatt | |
| 8,359,709 | B2 * | 1/2013 | Van Gennep | E05D 11/1007 16/229 |
| 2009/0320194 | A1 * | 12/2009 | Lovatt | A47K 13/06 4/237 |
| 2012/0272441 | A1 | 11/2012 | Lovatt | |

OTHER PUBLICATIONS

International Search Report filed in PCT/US2015/011696 mailed May 8, 2015.

* cited by examiner

*Primary Examiner* — Janie Loeppke
(74) *Attorney, Agent, or Firm* — Rankin, Hill & Clark LLP

(57) ABSTRACT

A toilet device includes a seat having a main opening, a first leg connected with the seat for pivotal movement about a first axis, a second leg connected with the seat for pivotal movement about a second axis, a first hinge mechanism connecting the first leg with the seat, and a second hinge mechanism connecting the second leg with the seat. Each hinge mechanism can lock, and a bag holder can be provided on each leg.

17 Claims, 7 Drawing Sheets

PORTABLE TOILET DEVICE FOR A SMALL CHILD

BACKGROUND

A known portable toilet device for a small child includes a seat sized to accommodate a small child, and a pair of pivoting legs that can be folded inwardly for compact storage. Problems arise with the ease of use of these toilet devices.

SUMMARY

In view of the foregoing, a toilet device includes a seat having a main opening, a first leg connected with the seat for pivotal movement about a first axis, a second leg connected with the seat for pivotal movement about a second axis, a first hinge mechanism connecting the first leg with the seat, and a second hinge mechanism connecting the second leg with the seat. The first hinge mechanism includes a button moveable along the first axis between a first position and a second position. With the button in the first position, movement of the first leg with respect to the seat is precluded. Movement of the button along the first axis toward the second position places the first hinge mechanism in an unlocked state, which allows for pivotal movement of the first leg with respect to the seat. The second hinge mechanism can be configured similarly to the first hinge mechanism.

Another example of a toilet device includes a seat having a main opening, a first leg, a second leg, a first hinge mechanism connecting the first leg with the seat and a second hinge mechanism connecting a second leg with the seat. Each leg connects with the seat for pivotal movement about a first axis and a second axis, respectively. The first hinge mechanism includes an axle moveable in a first axial direction parallel with the first axis and toward an unlocked position. The axle is biased in a second axial direction, which is opposite the first axial direction, toward a locked position. The first hinge mechanism is configured to preclude pivotal movement of the first leg with respect to the seat when the axle is in the locked position and to allow pivotal movement of the first leg with respect to the seat when the axle is in the unlocked position.

Another example of a toilet device includes a seat having a main opening, a first leg and a second leg each connected with the seat for pivotal movement about a first axis and a second axis, respectively, and a bag holder on each leg. Each bag holder includes a plurality of resilient fingers. Each finger is configured to flex from a normal state when a predetermined force is applied to the respective finger. Each finger is also configured to return toward the normal when the predetermined force is removed or a lower force than the predetermined force is being applied to the respective finger.

DETAILED DESCRIPTION

Figure 1:
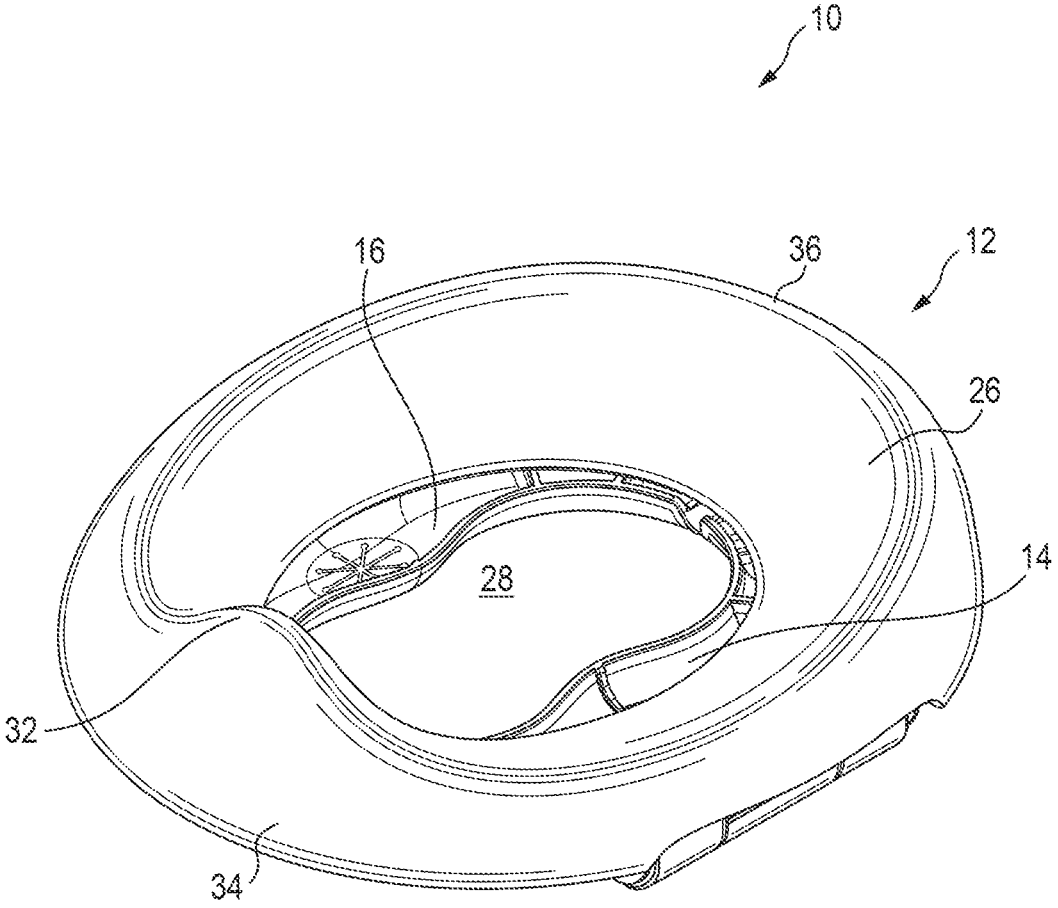
FIG. 1 is a perspective view of a toilet device with legs of the toilet device in a collapsed orientation.
Figure 2:
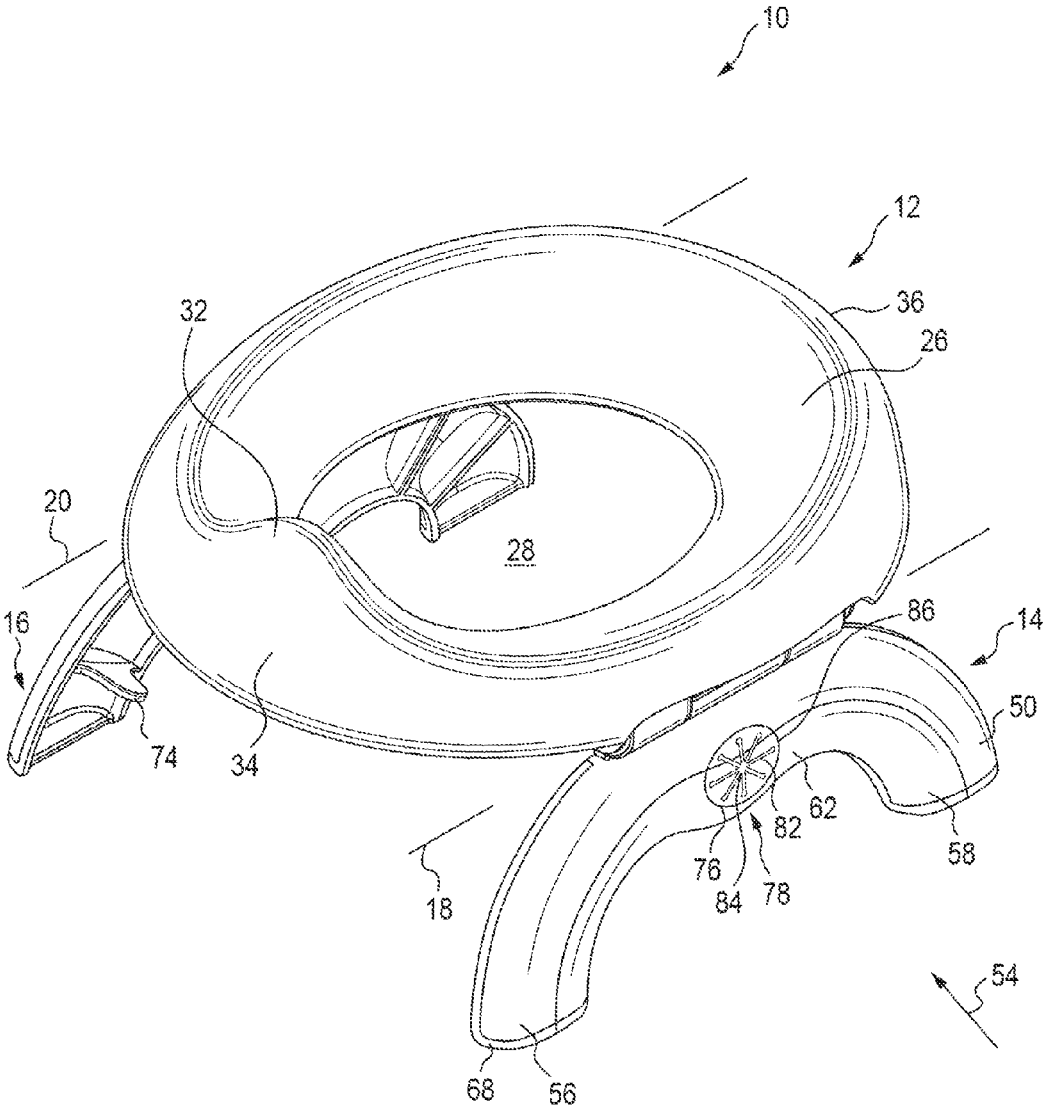
FIG. 2 is a perspective view of the toilet device with the legs in an upright orientation.
Figure 3:
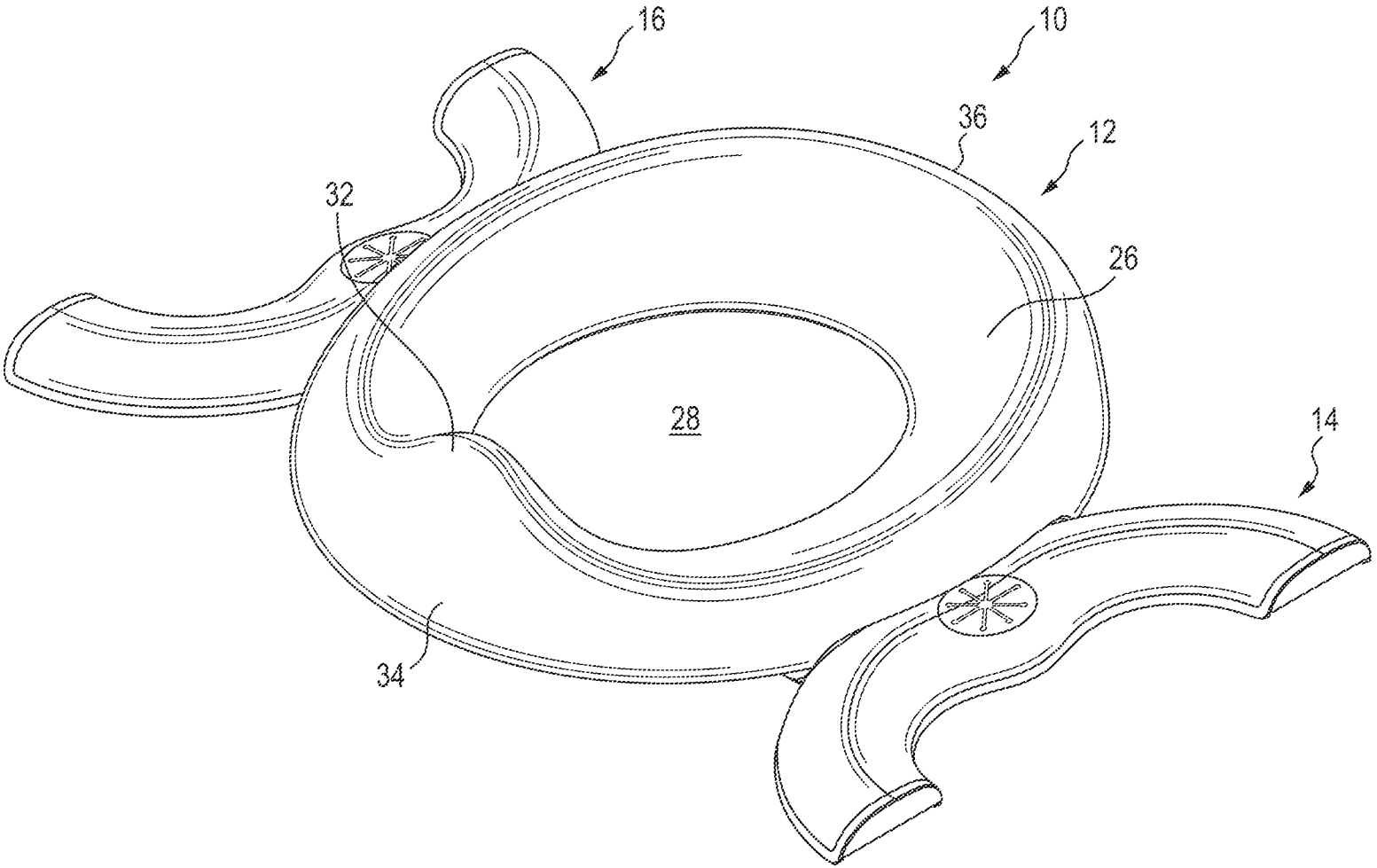
FIG. 3 is a perspective view of the toilet device with the legs in an extended orientation.

With reference to FIG. 1, a toilet device 10 includes a seat 12, a first leg 14 connected with the seat 12, and a second leg 16 connected with the seat 12. With reference to FIG. 2, the first leg 14 connects with the seat 12 for pivotal movement about a first axis 18. The second leg 16 connects with the seat 12 for pivotal movement about a second axis 20, which is parallel with the first axis 18. Each leg 14, 16 is moveable between a collapsed (first) orientation, which is shown in FIG. 1, an upright (second) orientation, which is shown in FIG. 2, and an extended (third) orientation, which is shown in FIG. 3. In the collapsed orientation, the legs 14, 16 are folded toward each other and toward the seat 12. In the upright orientation, the legs 14, 16 are generally upright, or vertical, and at a right angle to the seat 12. In the extended orientation, the legs 14, 16 extend away from the seat and each other and are generally parallel with the seat 12.

The seat 12 is generally annular having a seating surface 26 surrounding a main opening 28. The seat 12 includes a hump 32 formed in a forward section 34, which is opposite of rear section 36 of the seat 12. The seat 12 is formed to be generally U-shaped cross-section taken through a diameter of the seat (see also FIG. 5). The seat 12 forms a lower U-shaped channel 38 under the seating surface 26.

Figure 5:
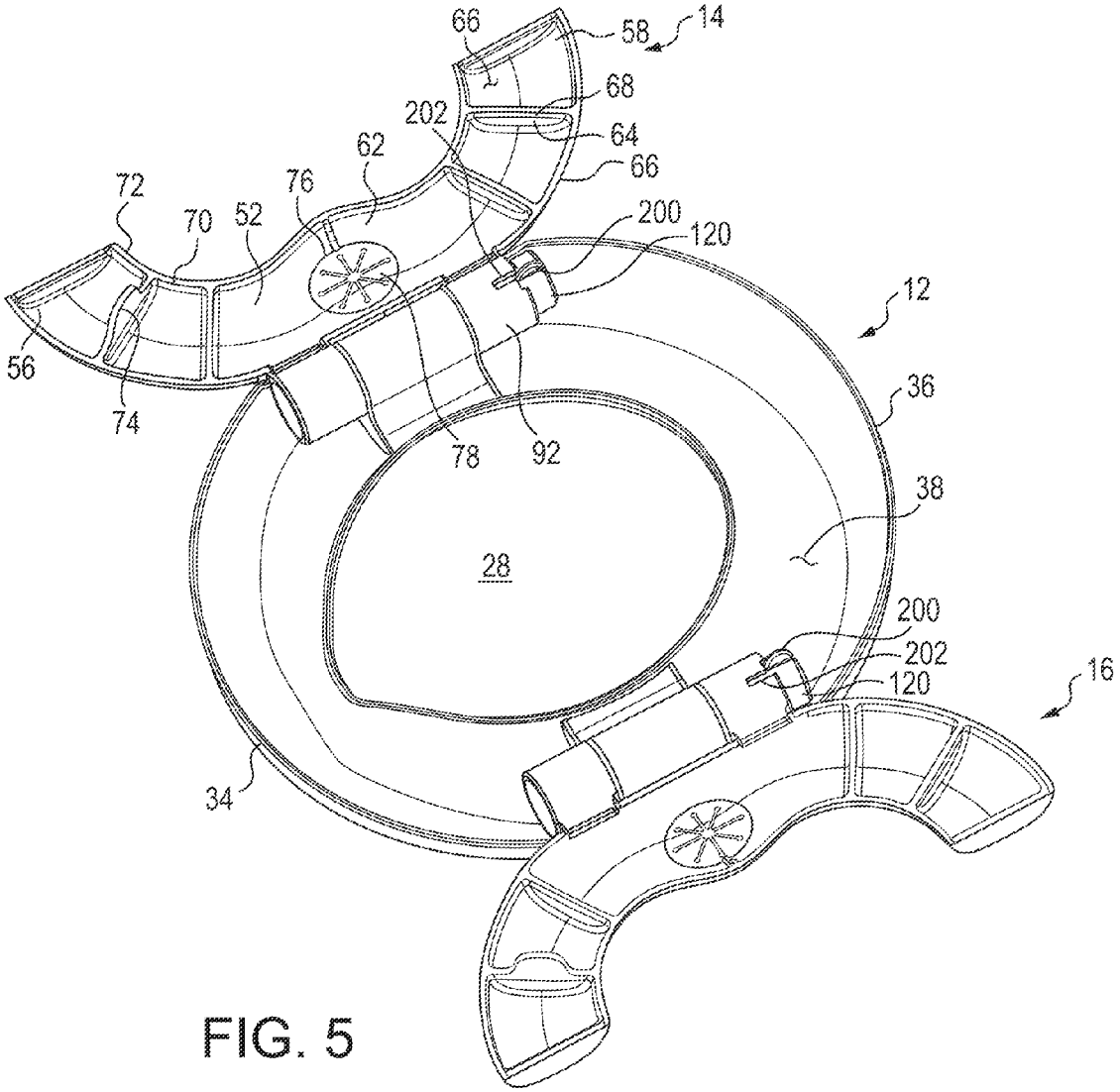
FIG. 5 is a perspective view of an underside of the toilet device with the legs in the extended position.

The first leg 14 and the second leg 16 are mirror images of one another. Accordingly, only the first leg 14 will be described with particularity for the sake of brevity. With respect to FIG. 2, the first leg 14 includes an outer surface 50 and an inner surface 52 (FIG. 5). The first leg 14 is U-shaped in side view, which is a view taken along the arrow 54 depicted in FIG. 2. The arrow 54 is perpendicular to the first axis 18. The U-shape of the leg 14 provides for a forward end section 56 and a rear end section 58. A central section 62 is disposed between the forward end section 56 and the rear end section 58.

The first leg 14 is also U-shaped in a cross-section taken normal to the first axis 18. With respect to FIG. 5, internal ribs 64 extend from the inner surface 52 and across an inner U-shaped channel 66 formed by the first leg 14. The internal ribs 64 provide rigidity to the first leg 14. The internal ribs 64 extend from the inner surface 52 and terminate at free edges 68, which are co-planar with an internal edge 70, which forms a support surface for the toilet device 10 when the legs are in the extended orientation (see FIG. 3). The free edges 68 of the internal ribs 64 and the internal edge 70 are coated with a resilient non-slip material 72. Ground engaging surfaces at the forward end section 56 and the rear end section 58 when the first leg 14 is in the upright position (FIG. 2) can also be covered with the resilient non-slip material 72.

A tab 74, which can be made from the resilient non-slip material 72, extends further away from the inner surface 52 of the leg 14 as compared to the free edges 68 of the internal ribs 64 and the internal edge 70. In the illustrated embodiment, the tab 74 extends from a forward-most internal rib 64. A respective tab 74 extends downwardly from each leg 14, 16 when the legs are in the extended orientation shown in FIG. 3. The tab 74 is to help keep the seat 12 centered on a standard toilet seat when the toilet device 10 is in the extended position shown in FIGS. 3 and 5. With the toilet device 10 resting on the standard toilet seat, a parent can push the toilet device 10 in a rearward direction until the tabs 74 engage the front of the standard toilet seat. At this location, the toilet device 10 should be fairly centered over the toilet bowl.

With reference to FIG. 2, the first leg 14 includes a bag holder opening 76 for receiving a respective bag holder 78. The bag holder opening 76 is centrally located between the forward section 34 and the rear section 36 of the seat 12. The bag holder opening 76 is also centrally located between the forward end section 56 and the rear end section 58 of the first leg 14. When the first leg 14 is in the upright position shown in FIG. 2, the bag holder 78 is offset from the ground and a bag handle of a plastic bag (not shown) can be inserted into the bag holder 78 without having to lift the first leg 14 from the ground.

The bag holder 78 includes a plurality of resilient fingers 82. Each finger 82 is configured to flex from a normal state (shown in FIG. 2) when a predetermined force is applied to the respective finger. Each finger 82 is also configured to return toward the normal state when the predetermined force is removed or a lower force than the predetermined force is being applied to the respective finger. In the illustrated embodiment, the resilient fingers 82 are triangular or pie-shaped. The fingers 82 extend inwardly toward a smaller central opening 84 from an edge 86 surrounding the bag holder opening 76 formed in the first leg 14.

As mentioned above, the bag holder 78 is configured to receive a respective handle of a plastic bag inserted in an insertion direction through the bag holder opening 76. For example, with the legs 14, 16 in the upright orientation as shown in FIG. 2, a plastic bag (not shown) is inserted through the main opening 28 and handles of the plastic bag are brought out over the seat 12 and the seating surface 26 and inserted through each of the bag holder openings 76. The handles can be inserted in the insertion direction, which in this example is from the outer surface 50 of the leg toward the inner surface 52. The resilient fingers 82 are configured to retain the handles of the plastic bag by engaging the handles after the respective handle has been inserted into the respective bag holder 78. Removal of the plastic bag from the toilet device 10 is made simple by pulling the handle out of the respective bag holder 78. Each bag holder 78 is configured to release the respective handle of the plastic bag when the handle is pulled through the bag holder opening 76 in a releasing direction, which is opposite the insertion direction, at a force greater than the predetermined force, which is the force at which the resilient fingers 82 flex. This allows for easy removal of the plastic bag as compared to known portable toilet devices, which can require lifting of the legs from the ground.

The bag holder 78 can be made from the same material as the resilient non-slip material 72 that is attached to the first leg 14. In the illustrated embodiment, the bag holder 78, the resilient non-slip material 72, and the tab 74 are all integrally formed and attached or molded together to the first leg 14.

Figure 4:
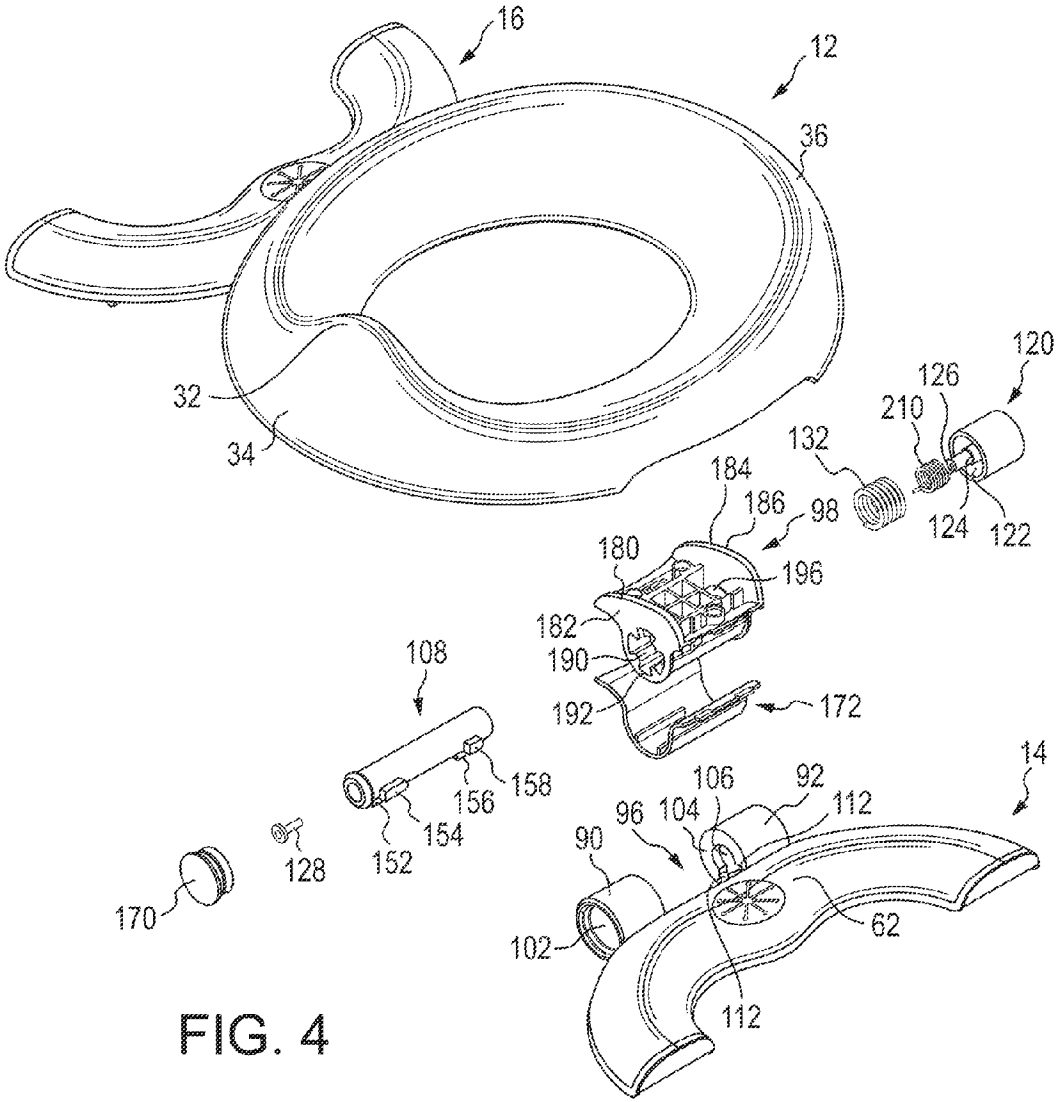
FIG. 4 is a partially exploded perspective view of the toilet device.

With respect to FIG. 4, a forward hub 90 and a rear hub 92 extend upwardly from the central section 62 of the first leg 14. The forward hub 90 is spaced from the rear hub 92 along the first axis 18 to define a gap 96 in which an axle support 98 is received. The forward hub 90 is a mirror image of the rear hub 92.

Each hub 90, 92 is cylindrical. Each hub 90, 92 includes an axial opening 102. Each hub 90, 92 includes a planar inner face 104 that faces toward the axle support 98 when assembled. A circular hole 106 is formed through each planar inner face 104 to the axial opening 102 and is coaxial with the axial opening. Each circular hole 106 has a diameter only slightly larger than the diameter of an axle 108, which will be described in more particularity below. Each circular hole 106 and each axial opening 102 receives the axle 108 when assembled. Catch openings 112 are open to and radiate outwardly from the circular hole 106. The axial openings 102 are circular in a cross-section taken normal to the first axis 18, i.e., there are not catch openings in the axial openings 102.

The hubs 90, 92, the axle support 98, and the axle 108 can make up a first hinge mechanism connecting the first leg 14 with the seat 12. A similar second hinge mechanism connects the second leg 16 with the seat 12. The first hinge mechanism includes the same components and operates in the manner as the second hinge mechanism; therefore, only the first hinge mechanism will be described with particularity.

Figure 6:
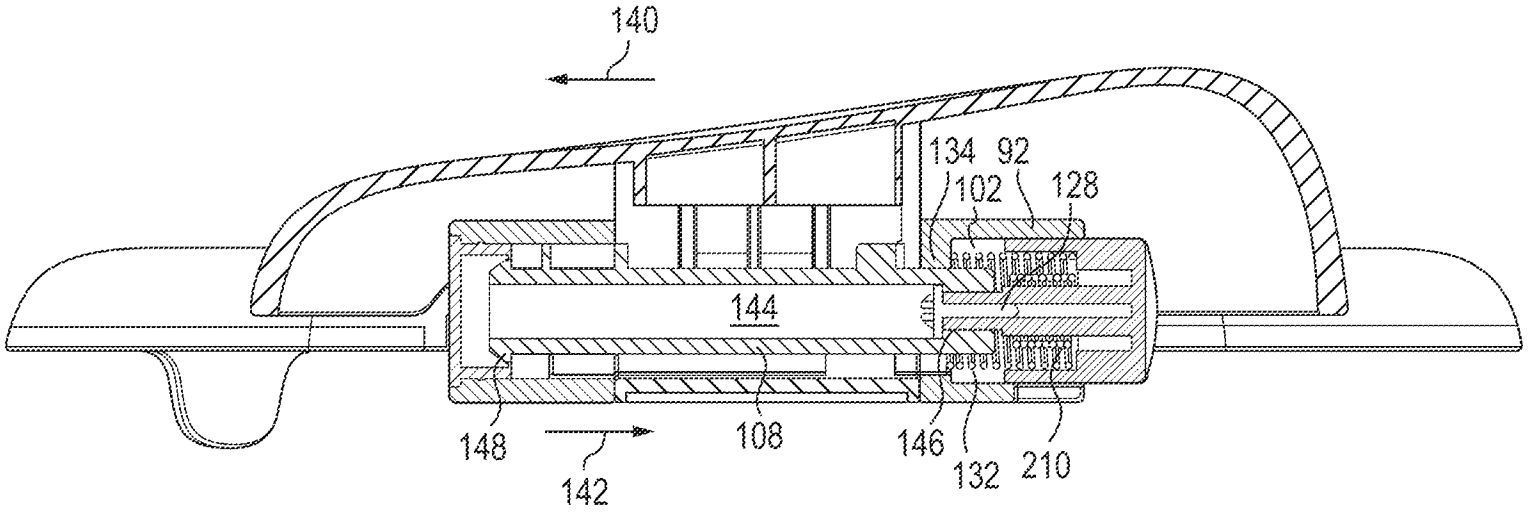
FIG. 6 is a cross-sectional view taken through a hinge mechanism of the toilet device with the hinge mechanism in a locked state.
Figure 7:
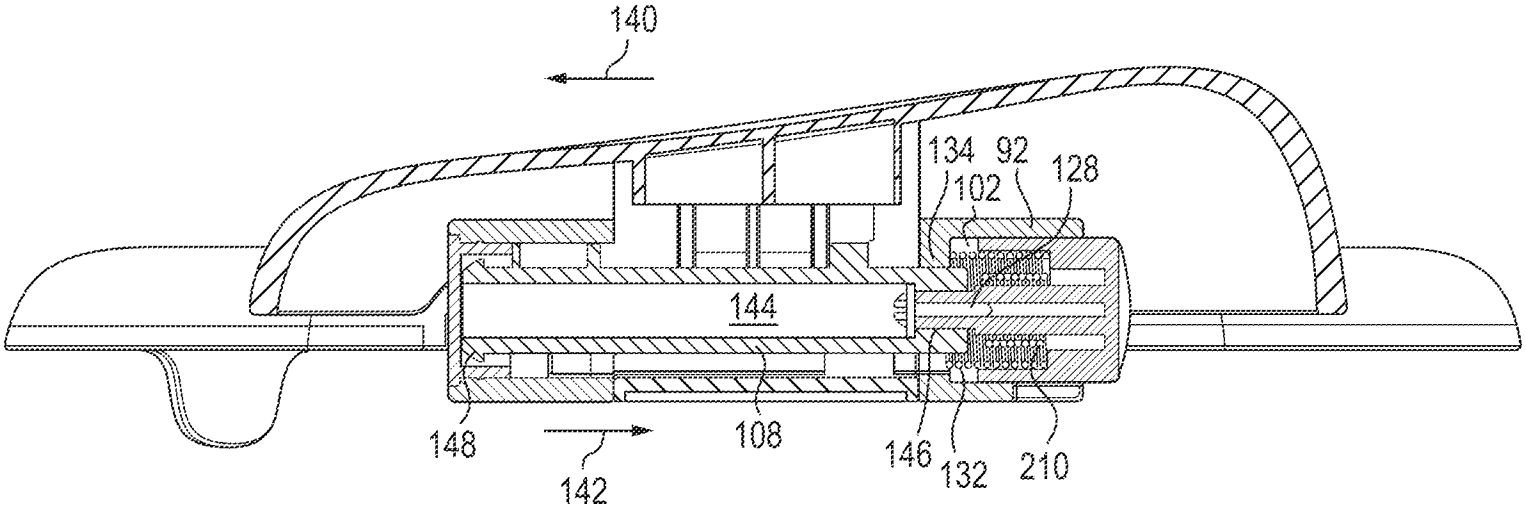
FIG. 7 is a cross-sectional view taken through the hinge mechanism of the toilet device with the hinge mechanism in an unlocked state.

The first hinge mechanism includes a button 120 that is moveable along the first axis 18. The button 120 is moveable between a first position, which is shown in FIG. 6, and a second position, which is shown in FIG. 7. With the button 120 in the first position, movement of the first leg 14 with respect to the seat 12 is precluded. Movement of the button 120 along the first axis 18 toward the second position (see FIG. 7) places the first hinge mechanism in an unlocked state, which allows for pivotal movement of the first leg 14 with respect to the seat 12.

The button 120 is generally cup-shaped having a hollow region 122 and a central boss 124, which is aligned with the first axis 18. A fastener opening 126 is provided in the boss 124. The fastener opening 126 allows for the attachment of the axle 108 to the button 120 using a fastener 128. The button 120 is biased along the first axis 18 toward the first position (shown in FIG. 6) by a spring 132. The spring 132 is received in the axial opening 102 of the rear hub 92 and the hollow region 122 of the button 120 surrounding the boss 124. The spring 132 acts against an annular flange 134, which surrounds the circular hole 106, found in the rear hub 92.

The axle 108 is also moveable in an axial direction parallel with the first axis 18. The axle 108 is moveable in a first axial direction, as depicted by arrow 140 in FIG. 6, toward an unlocked position, which is shown in FIG. 7. The axle 108 (and the button 120) is biased in a second axial, as depicted by arrow 142, toward a locked position, which is shown in FIG. 6. The first hinge mechanism is configured to preclude pivotal movement of the first leg 14 with respect to the seat 12 when the axle 108 is in the locked position (shown in FIG. 6) and to allow pivotal movement of the first leg 14 with respect to the seat 12 when the axle 108 is in the unlocked position (shown in FIG. 7). The axle 108 is operatively connected with the button 120 such that movement of the button 120 along the first axis 18 results in movement of the axle 108 along the first axis.

The axle 108 includes a central bore 144 that extends axially through the axle 108. The fastener 128 is inserted through the central bore 144 to connect the axle 108 with the button 120. The central boss 124 of the button 120 extends through an opening 146 and then into the central bore 144. The axle 108 also includes an annular flange 148, which in the illustrated embodiment is located at a distal end of the axle opposite to where the button 120 attaches with the axle. A protuberance on the axle 108 is provided to lock the first leg 14 with respect to the seat 12 in particular orientations, such as the orientations shown in FIGS. 1-3. With reference to FIG. 4, four protuberances 152, 154, 156, 158 are shown in the illustrated embodiment: a first forward protuberance 152 is angularly offset about 90 degrees from a second forward protuberance 154, and a first rear protuberance 156 is angularly offset about 90 degrees from a second rear protuberance 158. The forward protuberances 152, 154 are axially spaced from the rear protuberances 156, 158.

The first hinge mechanism also includes an end cap 170 that is received in the axial opening 102 of the forward hub 90. A cover 172 can also be provided to provide a decorative cover for the axle support 98. As more clearly seen in FIGS. 6 and 7, the end cap 170 can provide a limit on the travel of the axle 108 in the axial direction.

The axle support 98 includes a forward wall 180 having a forward planar surface 182 that faces the planar inner surface 104 of the forward hub 90. The forward planar surface 182 is normal to the first axis 18. The axle support 98 also includes a rear wall 184 having a rear planar surface 186 that faces the planar inner surface 104 of the rear hub 92. The rear planar surface 186 is normal to the first axis 18. The axle support 98 also includes an axle opening 190 having a diameter slightly larger than the axle 108 and in which the axle 108 is received. Catch openings 192 are formed in the forward wall 180. Although not visible in FIG. 4, catch openings are also formed in the rear wall 184 and are similar in shape, size and location as those shown in the forward wall 180. Four catch openings 192 are shown, each approximately 90 degrees from one another. The catch openings 192 cooperate with the protuberances 152-158 on the axle 108 to preclude rotation of the first leg 14 with respect to the seat 12.

The protuberances 152, 154, 156, 158 are received in a respective catch opening 192 when the axle 108 is in the locked position, which precludes rotation of the first leg 14 with respect to seat 12. The protuberances 152, 154, 156, 158 are not received in the catch openings 192 when the axle 108 is in the unlocked position (FIG. 7) which allows for rotation of the first leg 14 with respect to the seat 12. An axial gap 196 is provided in the axle support 98 to allow for this rotation. When the button 120 is pressed inwardly toward the second position (FIG. 7) the axle 108 moves in the first axial direction (arrow 140) so that the forward protuberances 152, 154 move out of the catch openings 192 formed in the forward wall 180 and the rear protuberances 156, 158 move out of the catch openings formed in the rear wall 184. This allows for the leg 14 to be rotated with respect to the seat 12. The forward protuberances 152, 154 remain engaged in the catch openings 112 formed in the forward hub 90 and the forward protuberances 152, 154 contact and move relative to the forward planar face 182 on the forward wall 180 of the axle support 98 as the first leg 14 rotates with respect to the seat 12. The biasing force of the spring 132 moves the button 120 toward the first position (in the direction of arrow 142) such that when the forward protuberances 152, 154 align again with respective catch openings 192, the axle 108 moves in the second axial direction toward the locked position. Since the catch openings in the rear wall 184 are aligned with the catch openings 192 in the forward wall 180, and the rear protuberances 156, 158 are aligned with the forward protuberances 152, 154, the rear protuberances 156, 158 can move into the respective catch openings in the rear wall 184 when the axle 108 is biased in the second axial direction (arrow 142).

The button 120 can also be moveable between an unlocked position and a locked position. When in the locked position, movement of the button 120 along the first axis 18 is precluded. This will also preclude movement of the axle 108 along the first axis 18. As such, the hinge mechanism remains in the locked state. When in the unlocked position, movement of the button 120 in a linear direction along the first axis 18 is allowed, which allows the axle 108 to also move along the first axis. In the illustrated embodiment, the button 120 rotates about the first axis 18 between the unlocked position and the locked position. As more clearly seen in FIG. 5, the button 120 includes a tab 200 that aligns with and is receivable in a slot 202 provided in the first hinge mechanism when the button is in the unlocked position. As illustrated, the slot 202 is formed in the rear hub 92 of each leg 14, 16. The button 120 for with the second hinge mechanism for the second leg 16 is shown in the locked position in FIG. 5. In this position the tab 200 is not aligned with the slot 202, which prevents the button 120 from being pressed inwardly along the second axis 20. A torsion spring 210, which is shown in FIGS. 6 and 7, can bias the button 120 to rotate towards the locked position such that an operator must overcome the biasing force to align the tab 200 with the slot 202 to allow the button to be pressed. Such a two-step operation, e.g., rotate and push for the button 120, can make the toilet device more child proof.

A toilet device has been described above with particularity. Modifications and alterations will occur to those upon reading and understanding the preceding detailed description. The invention, however, is not limited to only the embodiments described above. Instead, the invention is broadly defined by the appended claims and the equivalents thereof.

The invention claimed is:

1. A toilet device comprising:

a seat having a main opening;

a first leg connected with the seat for pivotal movement about a first axis;

a second leg connected with the seat for pivotal movement about a second axis;

a first hinge mechanism connecting the first leg with the seat; and a second hinge mechanism connecting the second leg with the seat, wherein the first hinge mechanism includes a button movable independently of the first leg along the first axis between a first position and a second position, with the button in the first position movement of the first leg with respect to the seat is precluded, wherein movement of the button along the first axis toward the second position places the first hinge mechanism in an unlocked state, which allows for pivotal movement of the first leg with respect to the seat.

2. The toilet device of claim 1, wherein the button is movable between an unlocked position and a locked position, when in the locked position movement of the button along the first axis is precluded, when in the unlocked position movement of the button along the first axis is allowed.

3. The toilet device of claim 2, wherein the button rotates about the first axis between the unlocked position and the locked position.

4. The toilet device of claim 2, wherein the button includes a tab that aligns with and is receivable in a slot provided in the first hinge mechanism when the button is in the unlocked position.

5. The toilet device of claim 1, wherein the first hinge mechanism includes an axle operatively connected with the button, wherein movement of the button along the first axis results in movement of the axle along the first axis.

6. The toilet device of claim 1, further comprising a bag holder on each leg, each bag holder including a plurality of resilient fingers.

7. A toilet device comprising:

a seat having a main opening;

a first leg and a second leg, each leg connected with the seat for pivotal movement about a first axis and a second axis, respectively; and a first hinge mechanism connecting the first leg with the seat and a second hinge mechanism connecting the second leg with the seat, wherein the first hinge mechanism includes an axle movable in a first axial direction parallel with the first axis and toward an unlocked position, and a spring biasing the axle in a second axial direction, which is opposite the first axial direction, toward a locked position, and the first hinge mechanism being configured to preclude pivotal movement of the first leg with respect to the seat when the axle is in the locked position and to allow pivotal movement of the first leg with respect to the seat when the axle is in the unlocked position.

8. The toilet device of claim 7, wherein each leg is movable between a first orientation where the legs are folded toward the seat, a second orientation where the legs are generally upright, and a third orientation where the legs extend away from the seat.

9. The toilet device of claim 7, wherein the first hinge mechanism includes an axle support including an axle opening in which the axle is received and a catch opening offset from the axle opening, and a protuberance on the axle is received in the catch opening when the axle is in the locked position.

10. The toilet device of claim 9, wherein the protuberance on the axle is not received in the catch opening when the axle is in the unlocked position, which allows for rotation of the first leg with respect to the seat.

11. The toilet device of claim 9, wherein the axle support includes a planar face normal to the first axis and a plurality of catch openings are offset from the axle opening, at least a portion of at least one of the plurality of catch openings is formed in the planar face, and the protuberance contacts and moves relative to the planar face as the first leg rotates with respect to the seat.

12. The toilet device of claim 7, wherein the first hinge mechanism includes a button configured to be pressed by an operator, wherein the button is operatively connected with the axle such that pressing the button results in movement of the axle toward the unlocked position, and the button is rotatable with respect to an axle support including an axle opening in which the axle is received.

13. A toilet device comprising:

a seat having a main opening;

a first leg and a second leg, each leg connected with the seat for pivotal movement about a first axis and a second axis, respectively, and each leg includes a bag holder opening;

a bag holder received in each bag holder opening on each leg, each bag holder including a plurality of resilient fingers extending inwardly toward a smaller central opening from an edge surrounding the bag holder opening, each finger is configured to flex from a normal state when a predetermined force is applied to the respective finger, each finger is also configured to return toward the normal state when the predetermined force is removed or a lower force than the predetermined force is being applied to the respective finger; and a tab extending downwardly from each leg when the legs are in an extended orientation where the legs extend away from the seat and each other, each tab being configured to engage a standard toilet seat when the toilet device is resting on the standard toilet seat so as to center the seat with respect to the standard toilet seat, wherein each tab is integrally formed with a respective bag holder.

14. The toilet device of claim 13, wherein each bag holder is configured to receive an associated plastic bag inserted in an insertion direction through the bag holder opening, and the resilient fingers are configured retain the associated plastic bag by engaging the associated plastic bag after the respective associated plastic bag has been inserted.

15. The toilet device of claim 14, wherein each bag holder is configured to release the respective handle of the associated plastic bag when the handle is pulled through the bag holder opening in a releasing direction, which is opposite the insertion direction, at a force greater than the predetermined force.

16. The toilet device of claim 13, wherein each bag holder opening is centrally located between a front section and a rear section of the seat.

17. The toilet device of claim 16, wherein each leg is generally U-shaped, and each bag holder opening is centrally located between a forward end section and rear end section of the respective leg.

* * * * *